United States Patent [19]

Vedeo et al.

[11] Patent Number: 5,076,159

[45] Date of Patent: Dec. 31, 1991

[54] REFUSE COLLECTOR WITH PIVOTED MEMBER FOR COMPRESSING REFUSE

[75] Inventors: Marco Vedeo; Roberto Dossena, both of Varazze, Italy

[73] Assignee: Valle Teiro S.r.l., Varazze, Italy

[21] Appl. No.: 534,956

[22] Filed: Jun. 8, 1990

[51] Int. Cl.[5] ..... B30B 13/00; B30B 7/00

[52] U.S. Cl. ..... 100/35; 100/233; 414/525.5; 414/525.53

[58] Field of Search ..... 100/35, 100, 218, 226, 100/233, 270, 271; 414/525.5, 525.51, 525.52, 525.53, 525.54

[56] References Cited

U.S. PATENT DOCUMENTS

| | | | |
|---|---|---|---|
| 3,143,230 | 8/1964 | Gollnick | 414/525.53 X |
| 3,759,406 | 9/1973 | Nickel | 100/233 X |
| 3,884,372 | 5/1975 | Kunii | 414/525.52 |
| 4,073,393 | 2/1978 | McKenzie et al. | 414/525.53 |
| 4,298,306 | 11/1981 | Chaudorge | 414/525.51 |
| 4,406,573 | 9/1983 | Colin | 100/233 X |

FOREIGN PATENT DOCUMENTS

| | | | |
|---|---|---|---|
| 2430905 | 3/1980 | France | 100/233 |
| 1158755 | 2/1987 | Italy . | |
| 54-138219 | 10/1979 | Japan | 414/525.53 |
| 2093902 | 8/1984 | United Kingdom . | |

*Primary Examiner*—Harvey C. Hornsby
*Assistant Examiner*—Stephen F. Gerrity
*Attorney, Agent, or Firm*—Marshall, O'Toole, Gerstein, Murray & Bicknell

[57] ABSTRACT

A refuse collector comprising a body defining a chamber for receiving refuse and a compactor for compacting refuse in the chamber, wherein the compactor includes a compression member for engaging and applying pressure to refuse in the chamber, a mounting member, a guide for guiding the mounting member for movement relative to the body and motors for moving the mounting member relative to the body and for moving the compression member relative to the mounting member, wherein the guide includes a rotary bearing mounted in a fixed position on the body and supporting the mounting member for pivoting relative to the body about a first axis, wherein the compression member is mounted on the mounting member for pivoting relative thereto about a second axis spaced from said first axis and wherein there is provided a control system for controlling pivoting of the mounting member relative to the body about the first axis and controlling pivoting of the compression member relative to the mounting member about the second axis.

10 Claims, 2 Drawing Sheets

REFUSE COLLECTOR WITH PIVOTED MEMBER FOR COMPRESSING REFUSE

BACKGROUND OF THE INVENTION

This invention relates to a refuse collector, hereinafter referred to a being "of the kind specified" comprising a body which defines a load space having a refuse-entry opening through which refuse can be loaded into the load space and the body being provided with a compaction means whereby refuse within the load space can be compacted. Hitherto, for example United Kingdom Patent 2,093,902, the compaction means has been provided on a tailgate mounted on the rear of the body.

When such a refuse collector is part of a vehicle the tailgate overhangs the rear wheels of the vehicle and can lead to undesirably high loads being applied to the rear wheels.

An object of the invention is to provide a new and improved refuse collector whereby the above mentioned problem is overcome or is reduced.

SUMMARY OF THE INVENTION

According to one aspect of the invention we provide a refuse collector of the kind specified wherein the compaction means is mounted at the top of the body.

The compaction means may include a refuse engageable compression member which extends into the load space via an opening in the top of the body.

Preferably the compaction means is mounted so as to be spaced forwardly from a rear end of the body having the refuse-entry opening.

The compression member may be movable between an inoperative position in which the compression member is at the top of the load space and an operative position in which the compression member may engage refuse in the load space to compact the thus engaged refuse and the compression member may be movable, when in said operative position, to compress said refuse.

The compression member may be movable generally downwardly from said inoperative position to said operative position.

The compression member may be movable longitudinally of the load space away from said opening to compress the refuse against a stop.

According to another aspect of the invention we provide a refuse collector of the kind specified wherein the compaction means comprises a compression member movable into an operative position in which the compression member is disposed within the load space in a position to engage refuse therein and movable longitudinally of the body, when in said operative position, away from said opening to compress refuse against a stop.

Thereafter the compression member may be movable into an inoperative position in which the compression member is disposed out of said position to engage refuse in the load space and movable longitudinally of the body, when in said inoperative position, towards said opening.

The compression member may be movable from said operative to said inoperative position in a direction generally transversely of said longitudinal direction of the body.

Said transverse direction may be generally downwardly.

In both aspects of the invention:

The stop may be movable longitudinally of the body away from the opening when the compression load applied to the stop exceeds a predetermined value.

The stop member may be movable longitudinally of the body towards the opening to discharge refuse from the body.

The compression member may be pivotally connected to a mounting member so that pivotal movement of the compression member relative to the mounting member moves the compression member between said operative and inoperative positions.

The mounting member may be pivotally mounted relative to the body so that pivotal movement of the mounting member relative to the body moves the compression member, when in said operative position, longitudinally of the body to compress the refuse.

The body may be provided with a guideway, which extends longitudinally of the body, on which a carriage is mounted for reciprocation by a first, or compaction, drive means.

The carriage may be connected by a linkage to said mounting member so that reciprocation of the carriage along the guide means, by the compaction drive means, causes pivotal movement of the mounting member and longitudinal movement of the compression member.

A second, or compression member, drive means may be provided between the carriage and the compression member to cause pivotal movement of the compression member relative to the mounting member between said operative and inoperative positions.

The refuse collector may be part of a vehicle, the rear wheels of the vehicle lying forwardly of said opening.

BRIEF DESCRIPTION OF THE DRAWINGS

Embodiments of the invention will now be described by way of example with reference to the accompanying drawings wherein.

DESCRIPTION OF THE PREFERRED EMBODIMENTS

Figure 1:
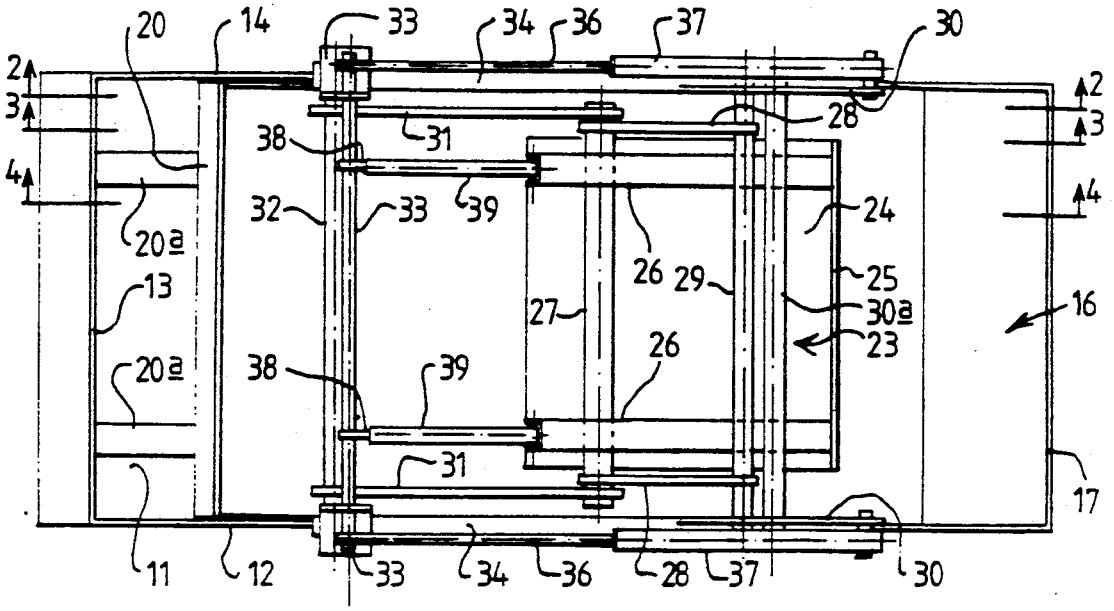
FIG. 1 is a plan view, with parts omitted for clarity, of a refuse collector embodying the invention.
Figure 2:
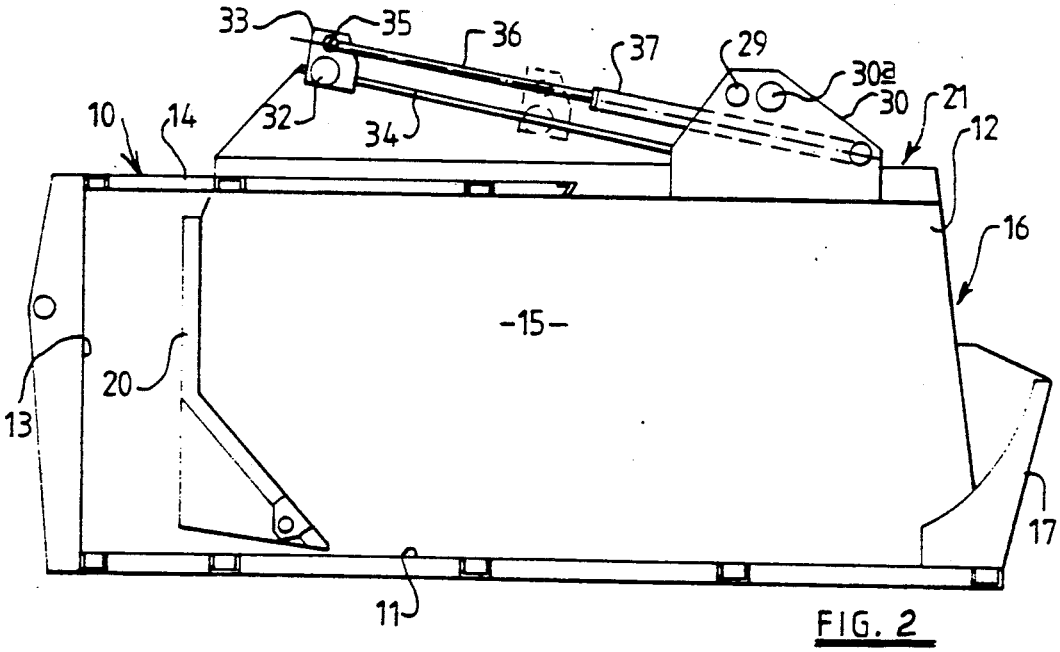
FIG. 2 is a section on the line 2—2 of FIG. 1.
Figure 3:
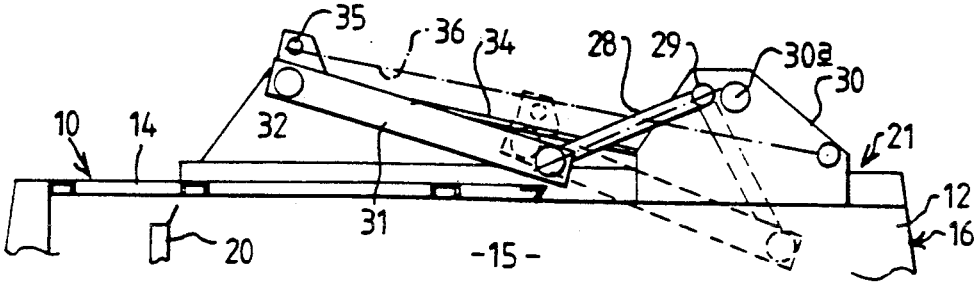
FIG. 3 is a fragmentary section on the line 3—3 of FIG. 1.
Figure 4:
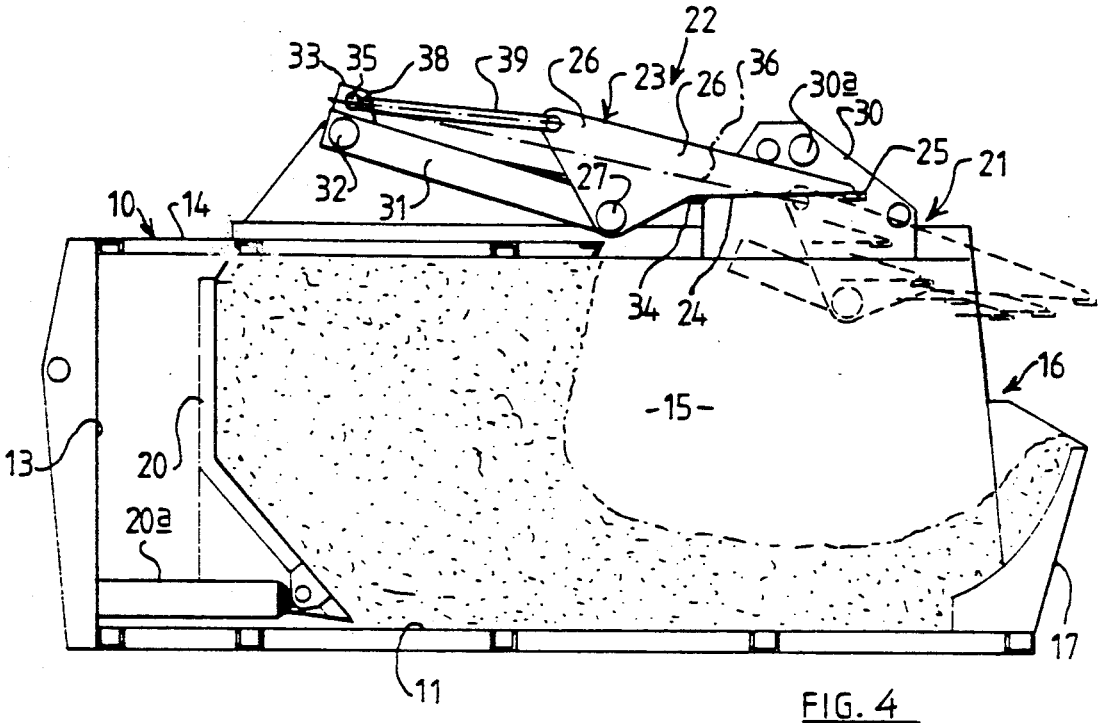
FIG. 4 is a section on the line 4—4 of FIG. 1.

Referring to the drawings, a refuse collector comprises an elongated body 10 of conventional construction having a bottom wall 11 spaced parallel side walls 12, a front end wall 13 and a top wall 14 which define a load space or chamber 15 and a refuse entry opening 16 through which refuse can be loaded into the load space 15. The opening 16 is provided with a lip 17 which can be pivoted downwardly from the position shown in the Figures to facilitate manual loading whilst providing a refuse containing capacity where a large amount of refuse is loaded into the space 15, for example from a skip.

A stop 20 is provided within the load space 15 and is mounted so as to be slidable longitudinally of the body towards and away from the opening 16 under the control of multi-stage hydraulic rams 20, as hereinafter to be described in more detail.

Mounted at the top 21 of the body 10 is a compaction means 22 which comprises a compression member 23 comprising a blade 24 having a reinforced edge 25 and, on the upper surface of the blade, upstanding brackets 26. The brackets 26 carry a cross-member 27 which is pivotally connected to a pair of mounting members 28 which are themselves pivotally mounted by means of an axle 29 to further brackets 30 mounted on the top of the body 10 and interconnected by a crossbrace 30*a*. The brackets 30 carry respective rotary bearings supporting the axle 29. Axle 29 defines a pivot axis which lies above the level of the top of the loading opening and about which axis the mounting members 28 can pivot relative to the body 10.

The cross-member 27 is also pivotally connected to linkage members 31 which are pivotally connected at their opposite ends to an axle 32 extending between carriages 33 mounted in any suitable manner for reciprocation on a pair of guideways or tracks 34. The carriages 33 carry a second axle member 35 which at its ends is connected to piston rods 36 of hydraulic rams 37 which provide a first, or compaction, drive means whereby the carriages 33 are reciprocated longitudinally of the body 10 on the guideways 34. The carriages 33 constitute transmission members and motion is transmitted from the rams 37 to the mounting members 28 via the carriages. The members, 31, carriages 33, guideways 34 and the member 35 constitute parts of guide means for guiding the compression member 23 for movement relative to the body 10. The rams 37 and 39 constitute control means for controlling pivoting of the mounting members 28 relative to the body 10 and controlling pivoting of the compression member 23 relative to the mounting members. The pivot axes defined by the axle 29, the axle 32 and the axle 35 are mutually parallel and are horizontal, when the bottom wall 11 of the body is horizontal.

The second axle 35 is also connected to piston rods 38 of further hydraulic rams 39 which provide a second, or compression member, drive means.

In use, during loading of refuse into the load space 15 through the opening 16, the compaction drive means 37 have their piston rods 36 thereof extended so that the carriages 33 are disposed away from the end of the body 10 having the refuse-entry opening 16, that is the position shown in full line in FIGS. 1–4. In addition, the compression member drive means 39 also have their piston rods 38 extended so that the compression member 23 is in the dotted line position shown in FIG. 5 with the edge 25 at point C. In this position free access is permitted to the load space 15 through the opening 16 so that refuse can be loaded into the body.

When it is desired to compact refuse and it is to be appreciated that the compaction operation is performed repeatedly during loading of the body, the compression member drive means 39 is actuated to retract the piston rods 38 and to pivot the compression member about the cross-member 27 so that the edge 25 follows the arc CD. The compaction drive means 37 is then actuated to retract the piston rods 36 to cause the mounting members 28 to pivot anti-clockwise about the axle 29 so that the edge 25 moves as shown in dotted line in FIG. 4 and hence follows the arc DA shown in FIG. 5 and the pivot axis about which the cross member 27 and the compression member 23 move relative to the mounting members moves along a corresponding arc from a position forwards of the axle 29 to a position rearwards of the axle 29. The compression member drive means 39 is then operated to extend the piston rods 38 which causes the compression member 23 to pivot so that the edge 25 moves through an arc indicated at AB so as to move the compression member 23 from the inoperative position shown in full line in FIG. 5 to an operative position shown in dotted line in FIG. 5 where the edge 25 lies at the position B and hence where the blade 24 is in position for compaction of the refuse. Of course, a certain amount of compaction of the refuse may occur during this pivotal movement of the compression member 23 about the cross-member 27.

After the compression member 23 has been moved to the operative position above described, the compaction drive means 37 is operated to extend the piston rods 36 to move the carriages 33 along the guideways 34 away from the opening 16. This, through the linkage members 31, causes the mounting members 28 to pivot about the axle 29 and this causes the compression member 23 to move longitudinally of the body away from the opening 16, as shown in FIG. 5, so that the edge 25 follows the arc BC and compresses the refuse against the stop 20.

When the reaction load experienced by the stop 20 exceeds a predetermined value, the multi-stage rams 20*a* permit movement of the stop 20 away from the opening 16 until the pressure is appropriately relieved. Accordingly, during each operation during filling of the body the refuse is compacted a predetermined amount against the stop. As further refuse is loaded and further compaction operation is performed the stop is progressively moved away from the opening 16.

Figure 5:
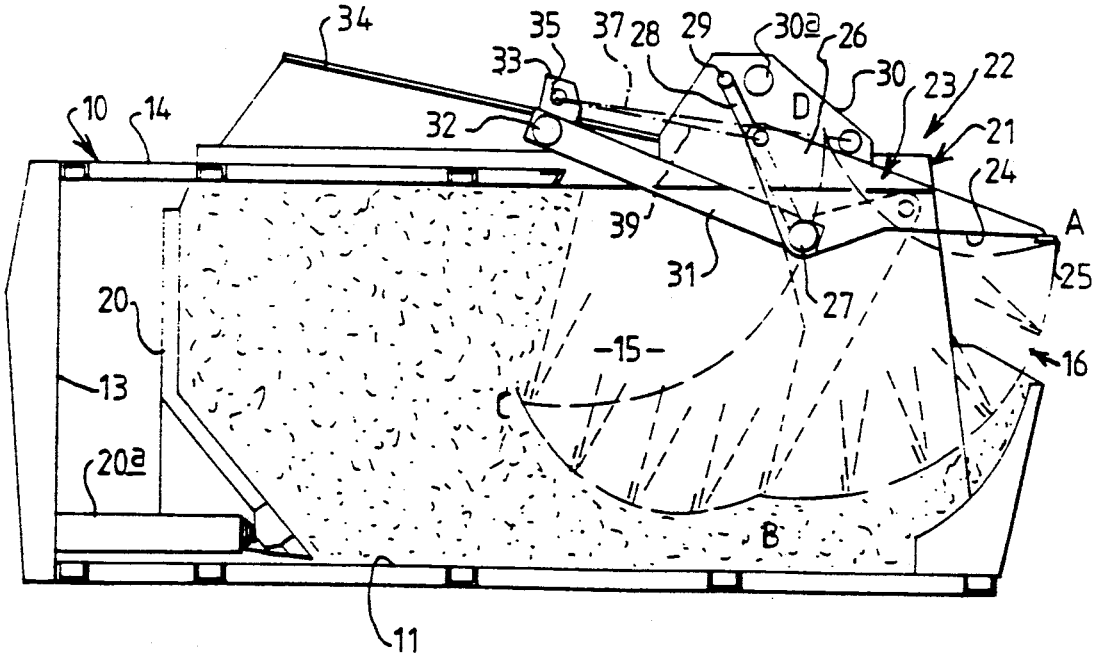
FIG. 5 is a section similar to that of FIG. 4, but showing a compaction means of the refuse collector in a different position.

After a compaction operation has been completed the compression member is maintained in the above described compression position, that is with the edge 25 at point C in FIG. 5, during further loading of refuse through the opening 16 and until a further compression operation is performed.

Although in the above described example the guideways 34 have been shown inclined upwardly away from the opening 16, if desired they may be inclined at a different angle to that shown or may lie parallel to the bottom wall and top wall of the body. The guideways are mounted on the top wall.

In addition, although the compression member 23 has been described as being carried on pivotal mounting members 28, if desired the operating member may be mounted on mounting members which move rectilinearly, for example by virtue of being guided on the guideways 34 or similar guideways which may be parallel or inclined to the guideways 34.

If desired, instead of mounting the compression member 23 for pivotal movement between its operative and inoperative positions, the compression member may be mounted for sliding movement between said positions by providing a suitable guideway.

Although in the above described and preferred example the compression member has been described as being mounted on the top of the container, if desired it may be provided at other positions, for example on a side of the container, in which case the above described motions would take place as described hereinbefore but in a plane inclined at 90° to that described. In such an embodiment it may be preferred to provide two compression members which extend into the body from opposite sides thereof and which co-operate together to compact refuse.

In a further modification the compression member may be provided at the base of the body with the compression member extending upwardly and if desired, a compression member may be provided at the top and at the bottom of the body, the compression members co-operating to compact refuse. Where a compression member extends into the body through the base or side wall, suitable closure means are provided to prevent egress of refuse through the openings required in the base or side wall to permit of access by the compression member.

The features disclosed in the foregoing description, or the following claims or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

We claim:

1. A refuse collector comprising a body defining a chamber for receiving refuse and a compactor for compacting refuse in the chamber, wherein the body includes a bottom wall, a top wall, opposite side walls extending from the bottom wall to the top wall, the compactor is at least partly mounted on the top wall, the compactor comprises a compression member for engaging and applying pressure to refuse in the chamber, a mounting member supported for pivoting relative to the body about a first axis, the compression member being mounted on the mounting member for pivoting relative thereto about a second axis, first drive means for pivoting the compression member relative to the mounting member, second drive means for pivoting the mounting member relative to the body and a transmission member connected between the second drive means and the mounting member, wherein the first drive means also is connected with the transmission member to act between the transmission member and the compression member.

2. A collector according to claim 1 wherein the body further comprises a rear wall and wherein the bottom wall has a substantially flat upper surface which extends to the rear wall.

3. A refuse collector according to claim 1 wherein the body further comprises a rear wall mounted for movement relative to the other walls of the body and relative to the compactor.

4. A collector according to claim 1 further comprising a track for guiding the transmission member for movement along a predetermined path relative to the body, wherein the transmission member runs on the track and the second drive means reciprocates the transmission member along the track.

5. A refuse collector comprising a body which defines a load space having a refuse-entry opening through which refuse can be loaded into the load space and the body being provided with a compaction means whereby refuse within the load space can be compacted, wherein the compaction means is mounted at the top of the body, the body includes a bottom wall, a top wall and opposite side walls extending between the bottom wall and the top wall, the compaction means includes a mounting member movable relative to the body about a first pivot axis and a compression member connected with the mounting member for pivoting relative thereto about a second axis for engaging and exerting pressure on refuse loaded into the load space, the mounting member is connected with the body for pivoting relative thereto about the first axis between a forward position in which the second axis lies forwards of the first axis and a rearward position in which the second axis lies rearwards of the first axis, the first axis lies above the level of the top wall of the body, the mounting member extends downwards from the first axis to the second axis and wherein there is provided driving means for pivoting the compression member relative to the mounting member and for moving the mounting member relative to the body.

6. A refuse collector according to claim 5 wherein the first pivot axis is fixed with respect to the top wall of the body.

7. A refuse collector according to claim 5 wherein the driving means includes first drive means for pivoting the compression member relative to the mounting member and second drive means for pivoting the mounting member relative to the body, wherein the collector further comprises a transmission member, the transmission member is connected between the second drive means and the mounting member and wherein the first drive means is connected between the transmission member and the compression member.

8. A refuse collector according to claim 7 further comprising a track for guiding the transmission member for movement along a predetermined path relative to the body, wherein the transmission member runs on the track and the second drive means reciprocates the transmission member along the track.

9. A refuse collector according to claim 8 wherein the track is above the top wall of the body.

10. A method of compacting waste in a collector wherein there is provided a collector comprising a body defining a chamber for receiving the waste and a compactor for compacting the waste in the chamber, the body also defining a loading opening into the chamber and the compactor comprising a compression member for applying pressure to the waste, the compression member having a free edge, wherein waste is loaded into the chamber through the opening and the compression member is moved relative to the body about two, spaced axes so that the free edge moves along an orbital path, the compression member engaging the waste under pressure when the free edge moves along a part of said path, wherein the orbital path includes first and second lower arcs and first and second upper arcs and wherein both of said lower arcs include substantially horizontal portions.

* * * * *